US009422775B2

(12) United States Patent
Hallundbæk et al.

(10) Patent No.: US 9,422,775 B2
(45) Date of Patent: Aug. 23, 2016

(54) DOWNHOLE CASING SYSTEM

(75) Inventors: Jørgen Hallundbæk, Græsted (DK); Tomas Sune Andersen, Helsingør (DK)

(73) Assignee: WELLTEC A/S, Allerød (DK)

( * ) Notice: Subject to any disclaimer, the term of this patent is extended or adjusted under 35 U.S.C. 154(b) by 404 days.

(21) Appl. No.: 14/114,595

(22) PCT Filed: Apr. 27, 2012

(86) PCT No.: PCT/EP2012/057793
§ 371 (c)(1),
(2), (4) Date: Oct. 29, 2013

(87) PCT Pub. No.: WO2012/146727
PCT Pub. Date: Nov. 1, 2012

(65) Prior Publication Data

US 2014/0060846 A1 Mar. 6, 2014

(30) Foreign Application Priority Data

Apr. 29, 2011 (EP) ..... 11164295

(51) Int. Cl.
*E21B 17/18* (2006.01)
*E21B 43/08* (2006.01)
*E21B 34/06* (2006.01)

(52) U.S. Cl.
CPC ..... *E21B 17/18* (2013.01); *E21B 34/06* (2013.01); *E21B 43/08* (2013.01)

(58) Field of Classification Search
CPC ..... E21B 17/18; E21B 43/08; E21B 17/08; E21B 21/10
See application file for complete search history.

(56) References Cited

U.S. PATENT DOCUMENTS 6,220,357 B1 4/2001 Carmichael et al.
6,464,261 B1 10/2002 Dybevik et al.
(Continued)

FOREIGN PATENT DOCUMENTS

CN 1880723 A 12/2006
CN 101975049 A 2/2011
WO WO 2009/103999 8/2009

OTHER PUBLICATIONS

International Search Report for PCT/EP2012/057793, mailed Jun. 6, 2012.
(Continued)

*Primary Examiner* — Jennifer H Gay
*Assistant Examiner* — Steven MacDonald
(74) *Attorney, Agent, or Firm* — Nixon & Vanderhye P.C.

(57) ABSTRACT

The present invention relates to a casing module for being part of a downhole casing system, comprising a base pipe extending in a longitudinal direction and having a circumference, a functional assembly mounted over the base pipe to define a casing module flow path between the functional assembly and the base pipe, and a main flow path arranged substantially in a center of the base pipe and extending in a longitudinal direction of the casing system, wherein at least a part of the casing module flow path is an annular flow path extending both in the longitudinal direction of the base pipe and continuously around the entire circumference of the base pipe, and the base pipe has end sections at which a plurality of supporting structures protrude from an outer surface to provide support for the functional assembly, the supporting structures defining a plurality of casing module flow paths extending in the longitudinal direction. The present invention furthermore relates to a downhole casing system for performing operations in a wellbore containing well fluid.

13 Claims, 8 Drawing Sheets

(56) References Cited

U.S. PATENT DOCUMENTS

| | | | | |
|---|---|---|---|---|
| 7,909,097 | B2 | 3/2011 | Ayasse | |
| 2004/0149435 | A1 | 8/2004 | Henderson | |
| 2010/0096120 | A1 | 4/2010 | Ayasse | |
| 2011/0030965 | A1* | 2/2011 | Coronado | E21B 34/14 166/332.7 |

OTHER PUBLICATIONS

International Preliminary Report on Patentability for PCT/EP2012/057793, completed Aug. 6, 2013.

* cited by examiner

DOWNHOLE CASING SYSTEM

This application is the U.S. national phase of International Application No. PCT/EP2012/057793 filed 27 Apr. 2012 which designated the U.S. and claims priority to EP Patent Application No. 11164295.5 filed 29 Apr. 2011, the entire contents of each of which are hereby incorporated by reference.

FIELD OF THE INVENTION

The present invention relates to a casing module for being part of a downhole casing system, comprising a base pipe extending in a longitudinal direction and having a circumference, a functional assembly mounted over the base pipe to define a casing module flow path between the functional assembly and the base pipe, and a main flow path arranged substantially in a centre of the base pipe and extending in a longitudinal direction of the casing system. The present invention furthermore relates to a downhole casing system for performing operations in a wellbore containing well fluid.

BACKGROUND ART

In the design of a completion for an oil well, multiple screen modules are usually connected to cover the length of a producing zone. Typically, each screen module comprises individual inflow control means arranged in a base pipe of the screen module, directly under a filtering element. The inflow control means are often comprised by valves or throttles and a sliding sleeve to block and open the inflow control means, respectively. Such screen modules are often sealed off at opposite ends so that fluid, entering the filtering element of one screen module, cannot flow to the subsequent screen module. This configuration of screen modules requires the use of a large number of inflow control means and sliding sleeves in a completion. Using many sliding sleeves in a completion renders the construction, the maintenance and the ongoing operation and control of the completion more expensive. Another inexpedient issue of prior art screen modules is the position of the inflow control means. Inflow control means arranged in the base pipe of at screen module will often reduce the flow area or drift diameter of the screen module, thereby reducing flow and the size of tool that can be used in the well. Further, the flow between the filtering element and the base pipe of a screen module may be of great importance. The production along a single screen module or string of screen often varies considerably with high and low producing areas. It is desirable to provide a flow path between the filtering element and the base pipe, which is as unrestricted and continuous as possible. Multiple separated narrow flow paths along a screen module often result in some flow paths being overloaded, and some having excess capacity.

SUMMARY OF THE INVENTION

It is an object of the present invention to wholly or partly overcome the above disadvantages and drawbacks of the prior art. More specifically, it is an object to provide an improved downhole casing system wherein fluid flow along the outside of the casing is optimised to increase production or the yield of intervention procedures. Further, it is an object to provide a casing system wherein the inflow control is improved and the number of inflow control sections to be operated is reduced.

The above objects, together with numerous other objects, advantages, and features, which will become evident from the below description, are accomplished by a solution in accordance with the present invention by a casing module for being part of a downhole casing system, comprising a base pipe extending in a longitudinal direction and having a circumference, a functional assembly mounted over the base pipe to define a casing module flow path between the functional assembly and the base pipe, and a main flow path arranged substantially in a centre of the base pipe and extending in a longitudinal direction of the casing system, wherein at least a part of the casing module flow path is an annular flow path extending both in the longitudinal direction of the base pipe and continuously around the entire circumference of the base pipe, and the base pipe has end sections at which a plurality of supporting structures protrude from an outer surface to provide support for the functional assembly, the supporting structures defining a plurality of casing module flow paths extending in the longitudinal direction.

In an embodiment, the functional assembly may comprise a filtering element, such as a screen, mounted over the base pipe to provide a screen casing module for preventing scales in the well fluid from entering the casing module flow path.

Further, the functional assembly may comprise a perforated outer pipe element mounted over the base pipe to provide an injection casing module for injecting fluid into an annulus surrounding the downhole casing system.

Also, the functional assembly may comprise end rings mounted over the end sections of the base pipe.

The present invention may also relate to a downhole casing system for performing operations in a wellbore containing well fluid, the downhole casing system comprising at least one casing module as described above, and at least one inflow control module extending in a longitudinal direction and adapted to be connected with the casing module, the inflow control module comprising at least one control module flow path in fluid communication with the casing module flow path, a main flow path fluidly connected with the main flow path of the base pipe, and a plurality of connecting passages fluidly connecting the control module flow path with the main flow path extending through the inflow control module and the casing module.

Said downhole casing system may further comprise at least one coupling module extending in a longitudinal direction and adapted to be connected to the casing module and/or another module such as an inflow control module, the coupling module comprising at least one coupling flow path in fluid communication with the casing module flow path and/or the control module flow path, and a main flow path fluidly connected with the main flow path of the base pipe and/or the main flow path of the inflow control module.

Also, the present invention relates to a downhole casing system for performing operations in a wellbore containing well fluid, the downhole casing system comprising: at least one casing module comprising; a base pipe extending in a longitudinal direction and having a circumference, a functional assembly mounted over the base pipe to define a casing module flow path between the functional assembly and the base pipe, and a main flow path arranged substantially in a centre of the base pipe and extending in a longitudinal direction of the casing system, wherein at least a part of the casing module flow path is an annular flow path extending both in the longitudinal direction of the base pipe and continuously around the entire circumference of the base pipe.

By an annular flow path extending continuously around the entire circumference of the base pipe is meant a casing module flow path extending in a continuous manner 360 degrees around on an outside of the base pipe. A fluid flow along an outer surface of the base pipe is better distributed to optimise the flow of e.g. oil into the main flow path. A continuous flow path around a periphery of the base pipe prevents a restricted or overloaded flow path on one side of the base pipe, e.g. due to blocking scales or high flow volume on the other side, from reducing the overall flow properties of the casing module.

In one embodiment, the functional assembly may comprise a filtering element, such as a screen, mounted over the base pipe to provide a screen casing module for preventing scales in the well fluid from entering the casing module flow path.

In another embodiment, the functional assembly may comprise a perforated outer pipe element mounted over the base pipe to provide an injection casing module for injecting fluid into an annulus surrounding the downhole casing system.

The functional assembly may further comprise a filtering element mounted over the base pipe and a perforated outer pipe element mounted over the filtering element.

Also, a downhole casing system according to the invention may comprise: at least one inflow control module extending in a longitudinal direction and adapted to be connected with the casing module, the inflow control module comprising: at least one control module flow path in fluid communication with the casing module flow path, a main flow path fluidly connected with the main flow path of the base pipe, and a plurality of connecting passages fluidly connecting the control module flow path with the main flow path extending through the inflow control module and the casing module.

A plurality of connecting passages may also be provided in the base pipe of the casing module for fluidly connecting the casing module flow path and the main flow path of the base pipe. Thus, the plurality of connecting passages provided in the base pipe may be an alternative or a supplement to the inflow control module.

A downhole casing system according to the invention may further comprise: at least one coupling module extending in a longitudinal direction and adapted to be connected to the casing module and/or another module such as an inflow control module, the coupling module comprising: at least one coupling flow path in fluid communication with the casing module flow path and/or the control module flow path, and a main flow path fluidly connected with the main flow path of the base pipe and/or the main flow path of the inflow control module.

Further, internal threaded connections may be provided at the opposite ends of the coupling module.

In one embodiment, the base pipe may have end sections at which a plurality of supporting structures protrude from an outer surface to provide support for the functional assembly, the supporting structures defining a plurality of casing module flow paths extending in the longitudinal direction.

Hereby, the functional assembly mounted over the base pipe may better withstand the considerable force and tear induced by an iron rough neck when the casing modules, coupling modules and/or inflow control modules are assembled on the drilling rig.

External threaded connections may be provided at the opposite ends of the base pipe.

Also, an external threaded connection may be provided at one end of the base pipe and an internal threaded connection may be provided at an opposite end of the base pipe.

In another embodiment, the functional assembly may comprise end rings mounted over the end sections of the base pipe.

The end rings may be manufactured from a material providing increased strength and tear resistance to the functional assembly at the end sections Hereby, the casing modules may better withstand the considerable force and tear induced by an iron rough neck when the casing modules, coupling modules and/or inflow control modules are assembled on the drilling rig.

In another embodiment, the inflow control module may comprise a sliding sleeve arranged along a surface of the main flow path to control the flow through the connecting passages.

In yet another embodiment, the inflow control module may have end sections at which a plurality of longitudinal grooves may be arranged for providing part of the control module flow path, the inflow control module further comprising end rings mounted over the longitudinal grooves.

External threaded connections may be provided at opposite the ends of the inflow control module.

An external threaded connection may further be provided at one end of the inflow control module and an internal threaded connection may be provided at an opposite end of the inflow control module.

A downhole casing system according to the invention, wherein the inflow control module may comprise a plurality of longitudinal extending bores fluidly connecting the longitudinal grooves with the connecting passages.

In one embodiment, each of the connecting passages may comprise a circumferential groove connected to at least one of the longitudinally extending bores.

In another embodiment, the circumferential groove of one connecting passage may intersect the circumferential groove of another connecting passage.

Hereby, fluid may bypass a plug or a blocked valve arranged in the connecting passage and flow towards a subsequent connecting passage.

In yet another embodiment, one or more connecting passages may be provided in the casing module or in the coupling module for fluidly connecting the main flow path extending through the casing system with the casing module flow path and the coupling flow path, respectively.

Finally, valves, throttles and/or inflow control devices may be arranged in the connecting passages.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1A:
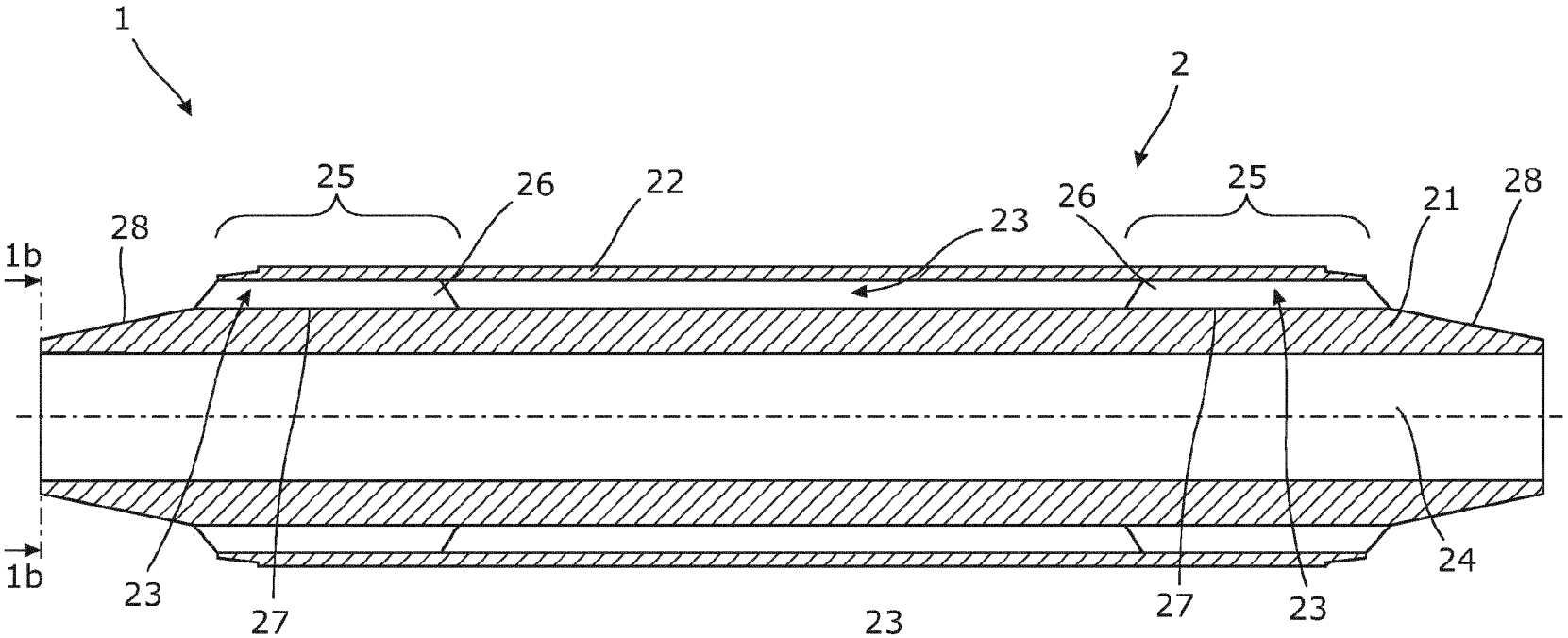
FIGS. 1*a* and 1*b* show a downhole casing system comprising a casing module.
Figure 1B:
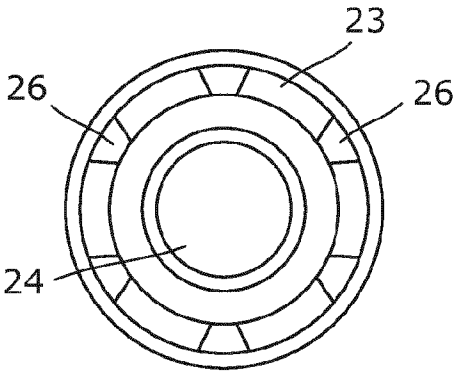

FIG. 1 shows a downhole casing system 1 for being lowered into a wellbore. When arranged in a wellbore, an annulus is defined between the casing system and the sides of the wellbore. The casing system comprises a casing module 2 adapted to be connected to other casing system modules described further in the following. The casing module 2 comprises a base pipe 21 extending in a longitudinal direction and having a circumference 211 as shown in FIG. 1*b*. The base pipe 21 has a hollow bore defining a main flow path 24 extending through the casing module 2. The main flow path 24 is shown substantially in a centre of the base pipe 21, but may in an alternative design be arranged off centre. Around the base pipe, a functional assembly 22 is mounted, thereby defining a casing module flow path 23 extending between the functional assembly 22 and the base pipe 21 in the longitudinal direction of the casing module. The functional assembly 22 is mounted at a distance from an outer surface 27 of the base pipe 21 to provide a casing module flow path 23 extending continuously around the entire circumference 211 of the base pipe. Thus, the casing module flow path 23 is an annular flow path extending both in the longitudinal direction of the base pipe and around the entire circumference 211 of the base pipe. By parts of the functional assembly not being supported around the circumference 211 of the base pipe, fluid may flow unhindered 360 degrees around the base pipe. A single uninterrupted flow path around the base pipe provides optimal flow conditions between the base pipe and the functional assembly by allowing distribution of fluids around the whole circumference 211 of base pipe. If an increased amount of fluid flows to or from a specific area of the casing module, the entire continuous encircling flow path can be used to direct the flow to or from that area. A fluid flow along an outer surface of the base pipe is better distributed to optimise the flow of e.g. oil into the main flow path. A continuous flow path around a periphery of the base pipe prevents a restricted or overloaded flow path on one side of the base pipe, e.g. due to blocking scales or high flow volume on the other side, from reducing the overall flow properties of the casing module.

Figure 4A:
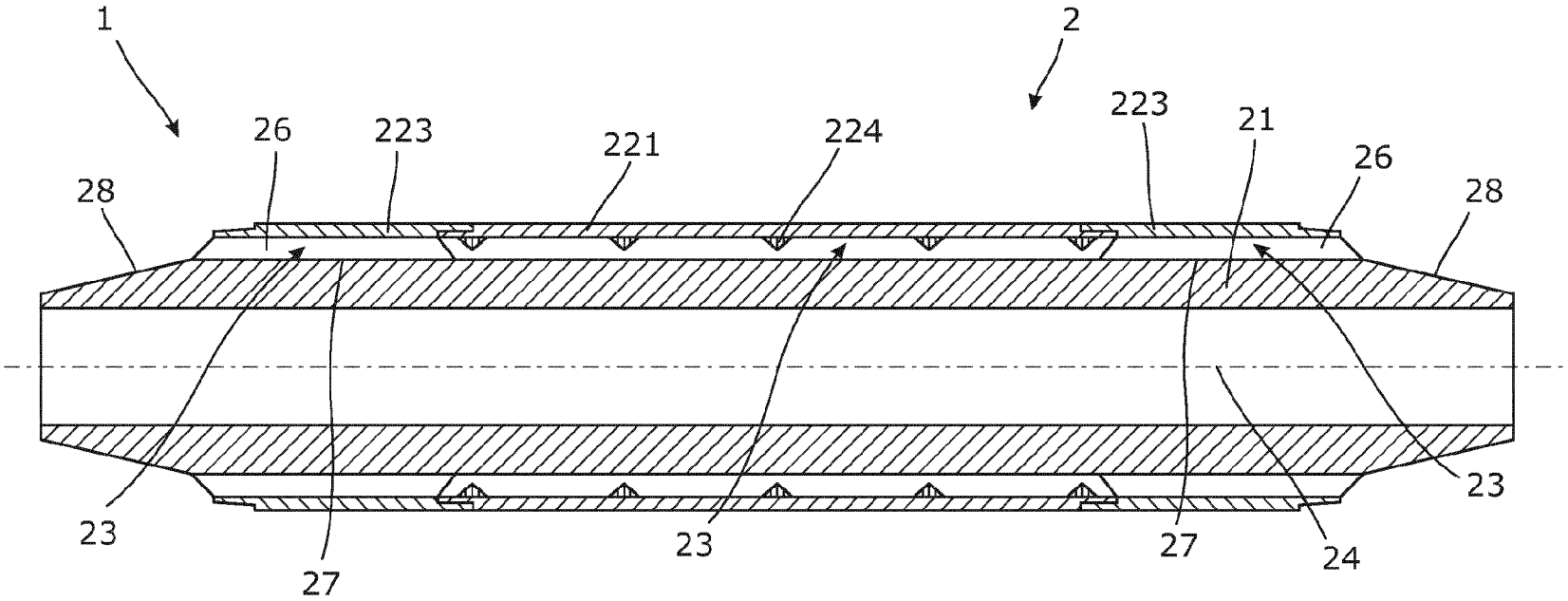
FIG. 4*a* shows a casing module comprising a filtering element.
Figure 4B:
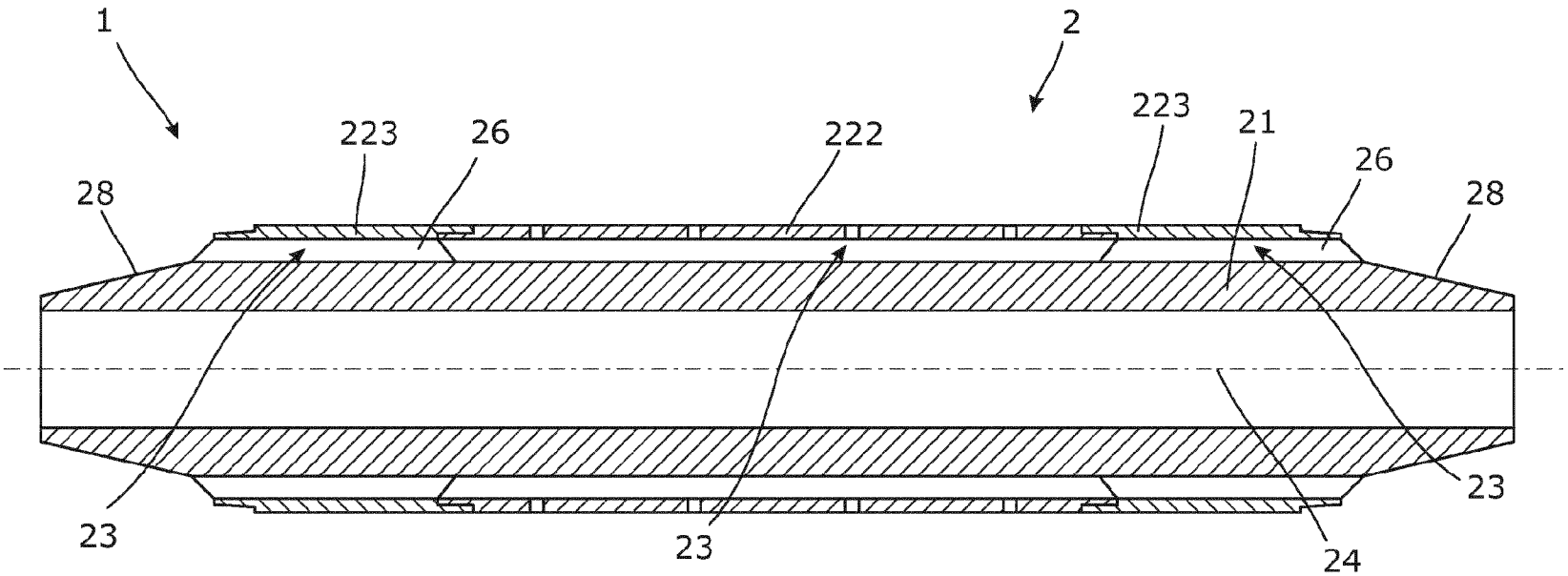
FIG. 4*b* shows a casing module comprising a perforated tubing element.
Figure 4C:
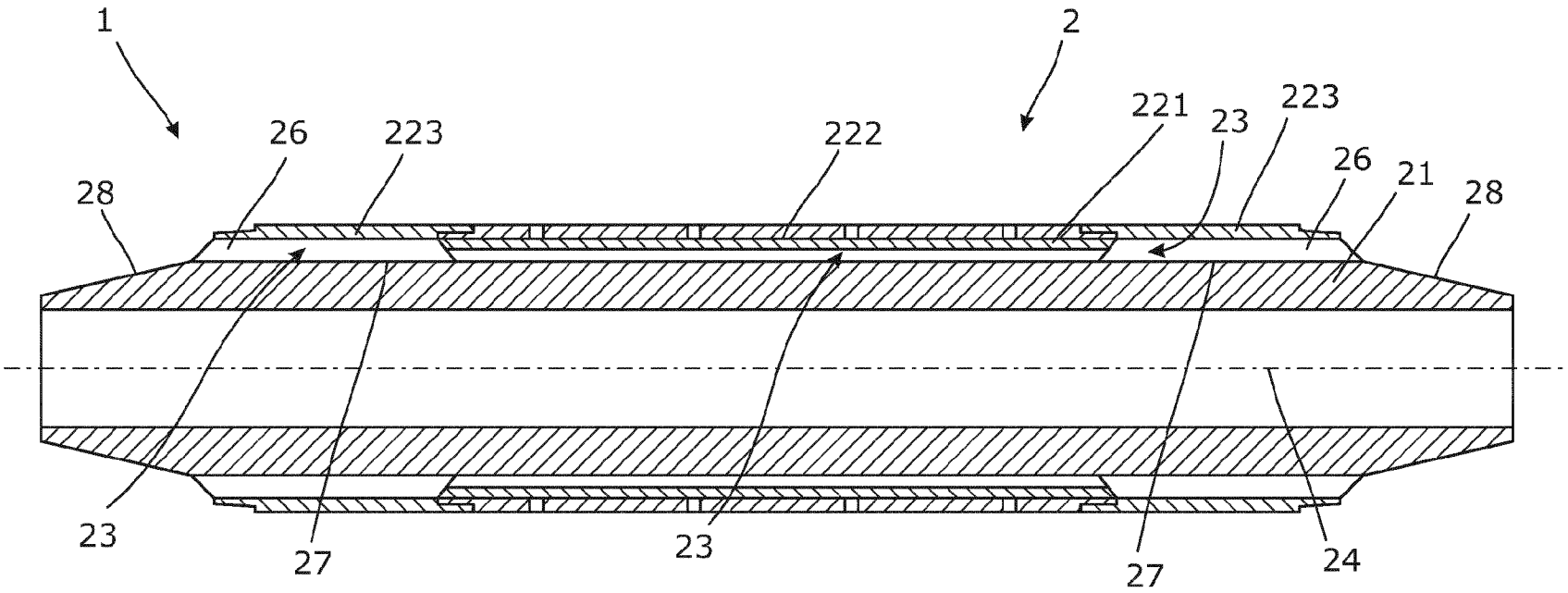
FIG. 4*c* shows a casing module comprising both a filtering element and a perforated tubing element.
Figure 4D:
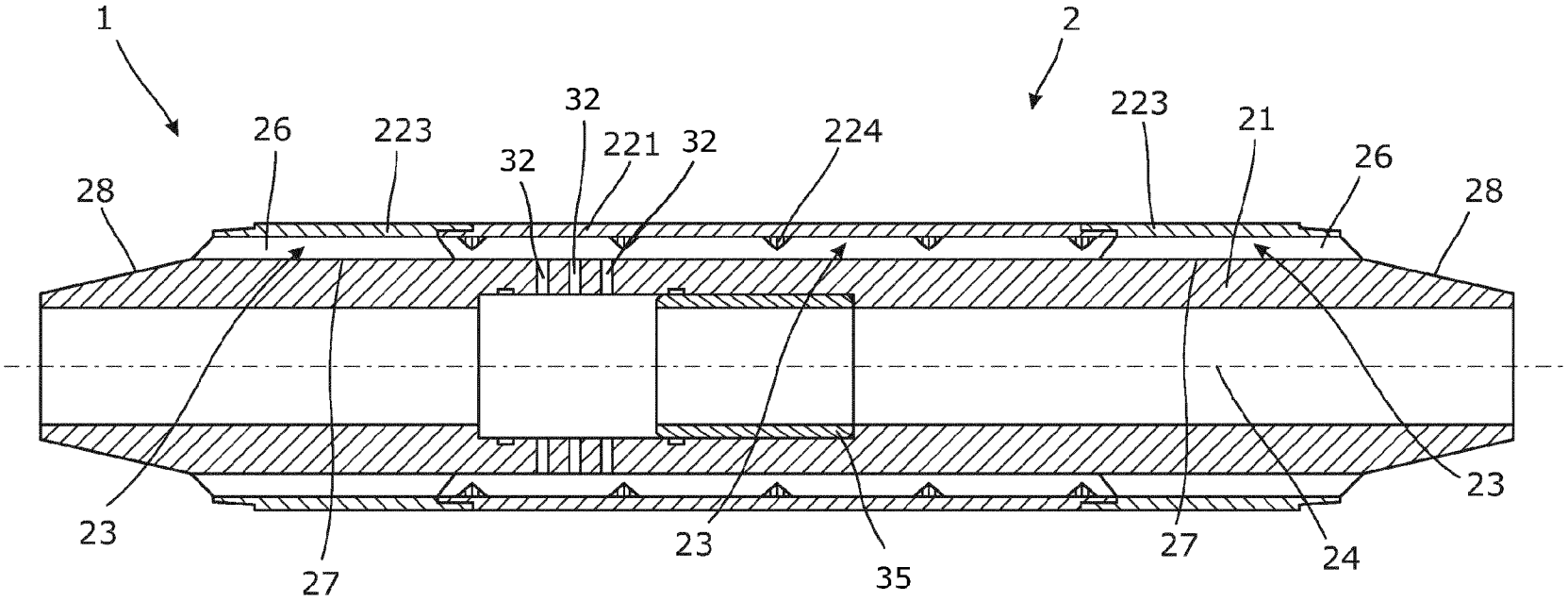
FIG. 4*d* shows a casing module comprising a filter element and connecting passages.

The functional assembly 22 may be constructed as one element as shown in FIG. 1*a* or by combining several elements connected with each other as shown in FIGS. 4*a*-4*c*.

The casing module 2 has end sections 25, defined as sections adjacent each end of the casing module. In each end section 25 a plurality of supporting structures 26 protrude from the outer surface 27 of the base pipe 21 to provide a support for the functional assembly 22. The functional assembly is thereby connected to the base pipe 21 via the supporting structures 26 and thus span an area of the base pipe located between the end sections 25. In the end sections, the supporting structures 26 divide the encircling casing module flow path 23 into a plurality of separate casing module flow paths each extending over a limited part of the circumference 211 of the base pipe 21 as shown in FIG. 1*b*. The plurality of separate casing module flow paths are defined by the supporting structures 26 and extend from the encircling casing module flow path towards the ends of the base pipe. The supporting structures 26 strengthen the casing module in the end sections so that when the casing module is connected with another casing module, e.g. by means of an iron rough neck on a drilling rig, the base pipe 21 of the casing module do not collapse.

Adjacent the ends, the separate casing module flow paths 23 are open and adapted to be connected to flow paths of abutting modules as described in the following. Further, the base pipe of the casing module comprises external threaded connections 28 at opposite ends for connecting the casing module 2 to other modules, as will also be described further below. It is obvious to the person skilled in the art that the threaded connections may be designed in a number of different ways, e.g. as internal threaded connections or as a combination.

FIGS. 4*a*-4*c* show different designs of a casing module 2 comprising different types of functional assemblies 22. In FIG. 4*a*, the functional assembly 22 comprises a filtering element 221 mounted over the base pipe 21 to provide a screen for the casing module 2. The filtering element 221 is mounted on a number of circular struts 224 arranged at a distance apart along the longitudinal direction of the casing module 2. The struts 224 encircle the base pipe 21 and provide structural integrity to the filtering element 221. The filter itself may be of various types such as, but not limited to, perforated tubing, a net of mesh arranged over the struts 224, a filtering element 221 wound around the struts 224 and possible additional supporting members, etc. The functional assembly 22 further comprises end rings 223 arranged in opposite ends of the filtering element 221 and mounted over the supporting structures 26 protruding at the end sections 25 of the base pipe 21. The filtering element 221 is connected to the end rings, e.g. by welding, to provide structural support to the filtering element. In one design of the functional assembly the end rings may be manufactured from a material adapted to withstand considerable force and tear induced by e.g. an iron rough neck when the casing modules are assembled on a drilling rig.

In FIG. 4*b*, the functional assembly 22 comprises a perforated outer pipe element 222 as an alternative to the filtering element 221. The perforated outer pipe element 222 is mounted over the base pipe 21 to provide an injection casing module for injecting fluid into the annulus surrounding the downhole casing system 1. The perforated outer pipe element 222 is connected to the base pipe 21 via a set of end rings 223 mounted at opposite ends of the perforated outer pipe element and arranged over the supporting structures 26 of the base pipe 21.

In FIG. 4*c*, the functional assembly comprises both a filtering element 221 and a perforated pipe element 222. The combination of a filtering element 221 and a perforated pipe element 222 may be used as a two step filter having varying filtering properties, as a combined screen and injection module, etc.

Figure 2A:
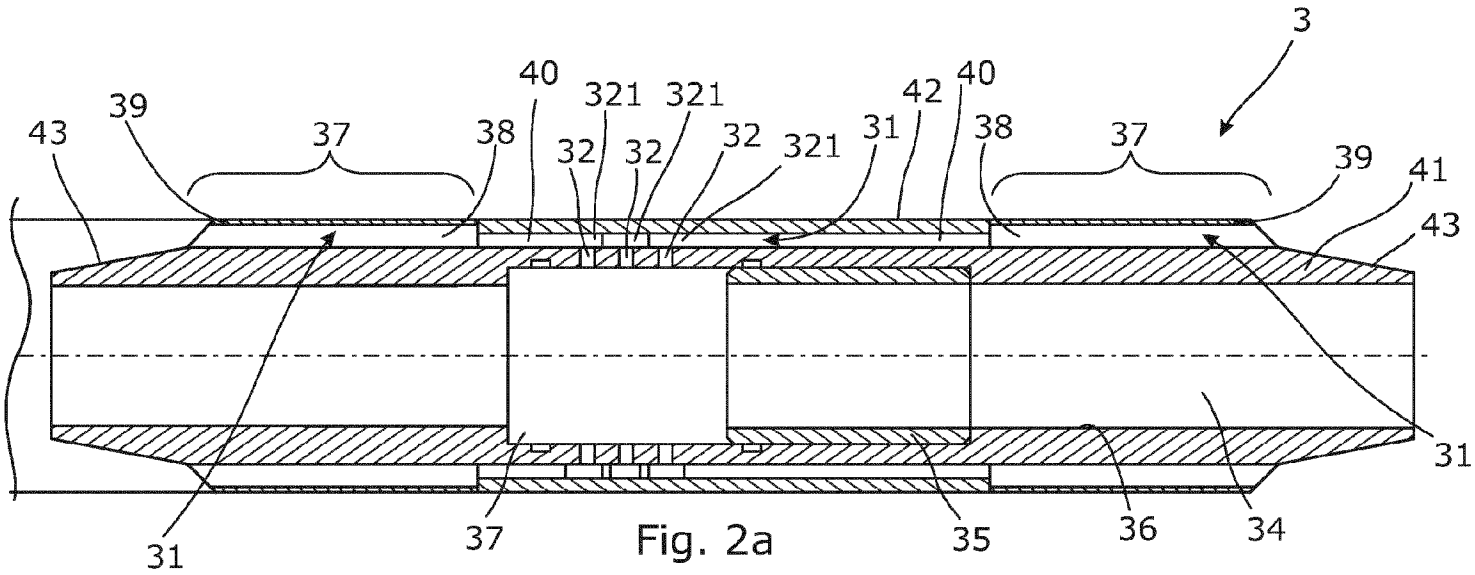
FIG. 2*a* shows a cross-section of an inflow control module.
Figure 2B:
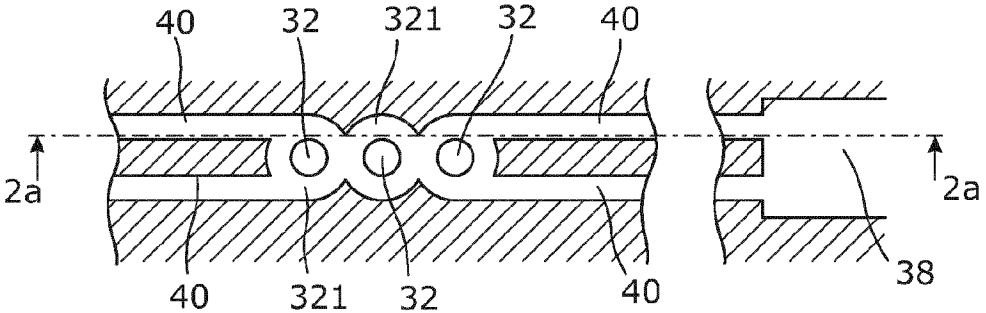
FIG. 2*b* shows a principle drawing of the connecting passages in an inflow control module.

FIG. 2*a* shows a cross-section of an inflow control module 3 taken along a line corresponding to the dotted line shown in FIG. 2*b*. The inflow control module extends in a longitudinal direction and is adapted to be connected with the casing module 2, either directly or via a connecting module as described below. The inflow control module 3 comprises a pipe element 41 having a hollow bore defining a main flow path 34 extending in a longitudinal direction from one end of the pipe element 41 to the other. In opposite ends of the pipe element 41 external threaded connections 43 are provided, for connecting the inflow control module 3 to other casing system modules 2, 3, 5.

When the inflow control module 3 is connected with a casing module 2, the main flow path 34 is fluidly connected with the main flow path 24 in the base pipe 21.

The pipe element has an outer surface 42 and an inner surface 36 encircling the main flow path 34. Adjacent the ends of the pipe element 41, end sections 37 of the inflow control module 3 are defined. In the end sections 37, the pipe element 41 comprises a plurality of longitudinal grooves 38 provided in the outer surface 42. The plurality of longitudinal grooves 38 provides part of a control module flow path 31 extending from one end of the control module to the other. The control module flow path 31 extends through the longitudinal grooves 38 in the end sections and through a middle portion of the pipe element 41 via a number of longitudinal extending bores 40 fluidly connecting the longitudinal grooves 38. In the longitudinal extending bores 40, a plurality of connecting passages 32 are provided to fluidly connect the control module flow path 31 with the main flow path 34. The connecting passages 32 may be open holes or provided with valves, e.g. pressure or fluid controlled valves, throttles or other inflow control devices. The inflow control device may be adapted to control the flow rate through the connecting passages and may be controllable e.g. from the surface of the well or by a tool operating downhole. The inflow control devices may be controlled by applying different pressure levels, specific fluids or other types of signals or commands.

As shown in FIG. 2*b*, two longitudinal extending bores 40 are provided between the longitudinal grooves 38 and the connecting passages 32. The longitudinal extending bores 40 are in fluid communication with the connecting passages 32 via a circumferential grove 321 provided in each of the connecting passages 32. By arranging the circumferential grooves 321 in a continuous pattern wherein a circumferential groove of one connecting passage intersects with the circumferential groove 321 of a subsequent connecting passage, the connecting passages become fluidly connected, thereby providing fluid communication between the longitudinal grooves 38. Hereby, fluid may bypass a blocked or overloaded connecting passage 32 and flow towards a subsequent connecting passage and/or inflow control module.

The inflow control module 3 further comprises a sliding sleeve 35 arranged in a recess 351 in the main flow path 34, for controlling the flow through the connecting passages. By arranging the sliding sleeve 35 in a recess 351 the sleeve does not reduce the maximum inner diameter of the hollow bore which could e.g. compromise the flow through the main flow path or hinder a tool from moving through the casing system. The sliding sleeve 35 is slidable between an open position, wherein the connecting passages are in fluid communication with the main flow path 34, and a closed position, wherein the fluid connection is cut off. The sliding sleeve is a conventional sliding sleeve and may be operated by any means known to the person skilled in the art. The inflow control module 3 further comprises end rings 39 mounted over the longitudinal grooves to seal of the control module flow path 31 from the annulus.

Figure 3A:
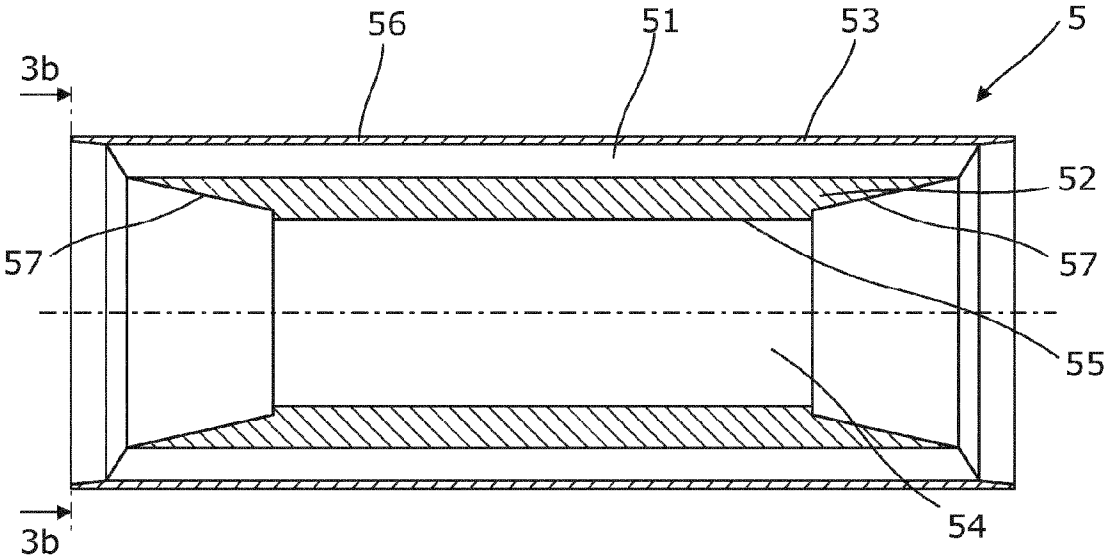
FIGS. 3*a* and 3*b* show a coupling module.
Figure 3B:
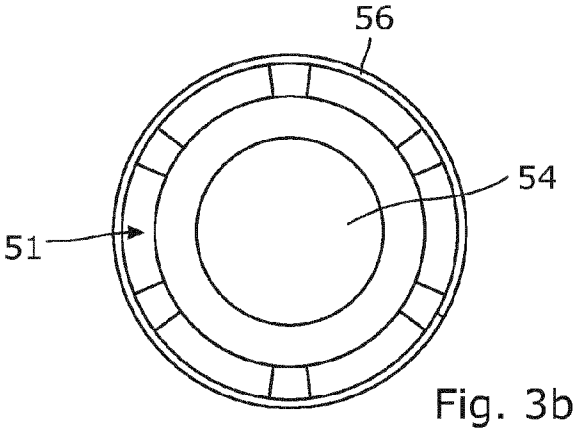

FIG. 3*.a* shows a coupling module 5 for interconnecting the casing modules 2 described above and for connecting inflow control modules 3 to the casing modules 2. The coupling module 5 extends in a longitudinal direction and comprises a pipe element 52 having an outer surface 53 and an inner surface 55 encircling a main flow path 54. In the outer surface 53, a number of coupling flow paths 51 are provided extending from one end of the pipe element to the other. The coupling flow paths 51 are covered by a cover element 56 encircling the pipe element. When the coupling element is connected to a casing module 2 or an inflow control module 3, the coupling flow paths 51 are in fluid communication with the casing flow paths 23 or the control module flow paths 31, respectively, and the main flow path 54 is fluidly connected to the main flow path of the casing module or the inflow control module, respectively. The coupling module 5 comprises internal threaded connections 57 in opposite ends of the pipe element.

As an alternative or a supplement to the inflow control module 3, a plurality of connecting passages 32 and a sliding sleeve 35 may be arranged in the base pipe of the casing module or in the pipe element of the coupling module. These connecting passages may provide fluid communication between the casing module flow path and the main flow path of the base pipe and between the coupling flow path and the main flow path of the coupling module.

In use, the modules of the downhole casing system 1 are assembled at the surface and continuously lowered into the wellbore. The modules may be assembled using regular tools available, such as an iron rough neck. According to the requested functionality of the casing system, the appropriate number and types of modules are assembled. Each of the casing module, the inflow control module and the coupling module is self-contained modules that are pre-assembled before the modules are assembled into the downhole casing system 1 and lowered into the well. Assembling two separate modules may thus be performed in one operation, not requiring assembly of multiple parts at the rig site. Consequently, the time required for the assembly of separate modules is reduced and the casing system may be lowered into the wellbore at a faster rate.

Figure 5:
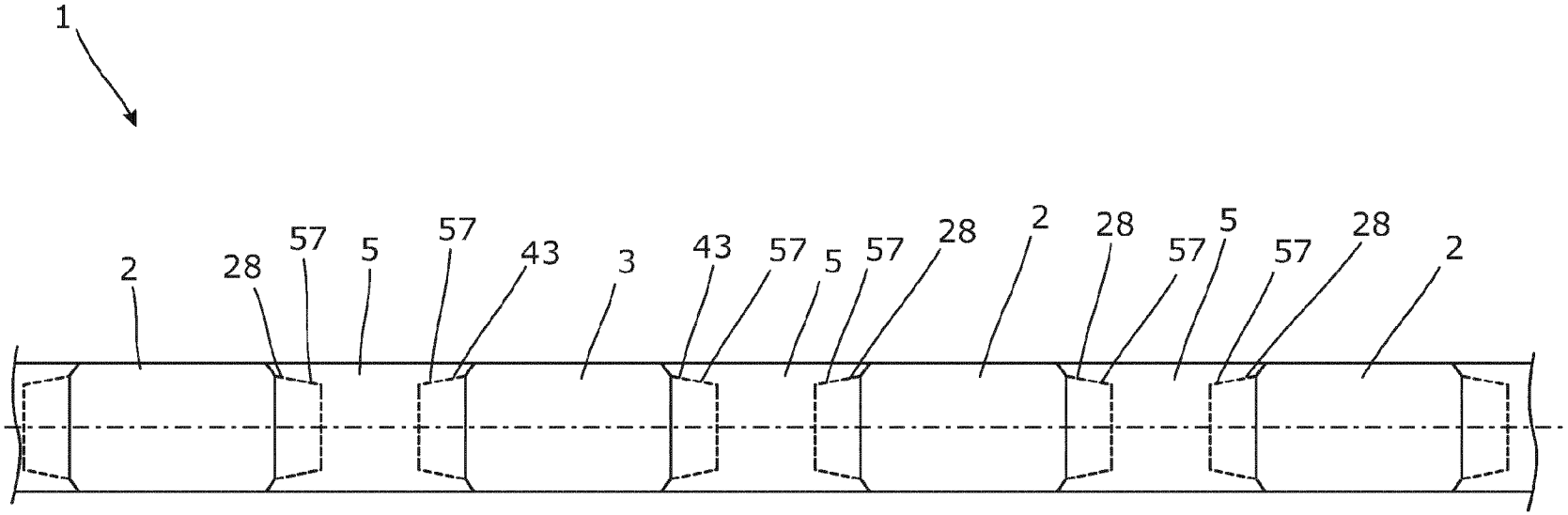
FIG. 5 shows a downhole casing system comprising different casing system modules connected to each other.

As shown in FIG. 5, the casing modules are attached to the coupling modules by connecting the external threaded connections 28 of the casing modules to the internal threaded connections 57 of the coupling modules. In a similar manner, the inflow control module 3 is attached to the coupling modules 5 by the external threaded connections 43 of the inflow control module 3 being connected to the internal threaded connections 57 of the coupling modules.

The downhole casing system 1 may comprise a string consisting of multiple casing modules interconnected by coupling modules 5 and coupled to a single inflow control module 3. Hereby, the number of inflow control modules 3 and sliding sleeves 35 are reduced. When the casing modules 2, the coupling modules 5 and the inflow control modules 3 are connected, the main flow paths 24, 34, 54 are in fluid communication, whereby hydro carbons or other well fluids may flow from the formation through the casing system towards the surface or injection fluids may be injected into the formation through the casing system. At the same time, the casing module flow path 23, the coupling flow path 51 and the control module flow path 31 are fluidly connected along the periphery of the casing system. Hereby, fluid may flow along multiple consecutive casing system modules 2, 3, 5 either from or into the formation.

As showed in the design, the downhole casing system comprises coupling modules for connecting other modules of the system. As should be obvious to the person skilled, the coupling modules may be omitted if the other casing system modules are provided with an internal threaded connection in one end and an external threaded connection in an opposite end. By utilising a system of alternating internal threaded female connections and external threaded male connections, the coupling modules become superfluous. A downhole system may thus be devised with no coupling modules, without departing from the subject matter of the invention.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing is meant any kind of pipe, tubing, tubular, liner, string etc. used downhole in relation to oil or natural gas production.

Although the invention has been described in the above in connection with preferred embodiments of the invention, it will be evident for a person skilled in the art that several modifications are conceivable without departing from the invention as defined by the following claims.

The invention claimed is:

1. A casing module for being part of a downhole casing system, comprising:

a base pipe extending in a longitudinal direction and having a circumference, a functional assembly mounted over the base pipe to define a casing module flow path between the functional assembly and the base pipe, and a main flow path arranged substantially in a centre of the base pipe and extending in a longitudinal direction of the casing system, wherein at least a part of the casing module flow path is an annular flow path extending both in the longitudinal direction of the base pipe and continuously around the entire circumference of the base pipe, the base pipe has end sections at which a plurality of supporting structures protrude from an outer surface to provide support for the functional assembly the supporting structures defining a plurality of casing module flow paths extending in the longitudinal direction, and wherein the annular flow path extends substantially the entire distance between the supporting structures at one of the end section to the supporting structures at the other end section.

2. A casing module according to claim 1, wherein the functional assembly comprises a filtering element mounted over the base pipe.

3. A casing module according to claim 1, wherein the functional assembly comprises a perforated outer pipe element mounted over the base pipe to provide an injection casing module for injecting fluid into an annulus surrounding the downhole casing system.

4. A casing module according to claim 1, wherein the functional assembly comprises end rings mounted over the end sections of the base pipe.

5. A downhole casing system for performing operations in a wellbore containing well fluid, the downhole casing system comprising:

at least one casing module according to claim 1, and at least one inflow control module extending in a longitudinal direction and adapted to be connected with the casing module, the inflow control module comprising:

at least one control module flow path in fluid communication with the casing module flow path, a main flow path fluidly connected with the main flow path of the base pipe, and a plurality of connecting passages fluidly connecting the control module flow path with the main flow path extending through the inflow control module and the casing module.

6. A downhole casing system according to claim 5, further comprising:

at least one coupling module extending in a longitudinal direction and adapted to be connected to the casing module and/or another module such as an inflow control module, the coupling module comprising:

at least one coupling flow path in fluid communication with the casing module flow path and/or the control module flow path, and a main flow path fluidly connected with the main flow path of the base pipe and/or the main flow path of the inflow control module.

7. A downhole casing system according to claim 5, wherein the inflow control module comprises a sliding sleeve arranged along a surface of the main flow path to control the flow through the connecting passages.

8. A downhole casing system according to claim 5, wherein the inflow control module has end sections at which a plurality of longitudinal grooves are arranged for providing part of the control module flow path, the inflow control module further comprising end rings mounted over the longitudinal grooves.

9. A downhole casing system according to claim 5, wherein the inflow control module comprises a plurality of longitudinal extending bores fluidly connecting the longitudinal grooves with the connecting passages.

10. A downhole casing system according to claim 9, wherein each of the connecting passages comprises a circumferential groove connected to at least one of the longitudinally extending bores.

11. A downhole casing system according to claim 10, wherein the circumferential groove of one connecting passage intersects the circumferential groove of another connecting passage.

12. A downhole casing system according to claim 5, wherein one or more connecting passages are provided in the casing module or in the coupling module for fluidly connecting the main flow path extending through the casing system with the casing module flow path and the coupling flow path, respectively.

13. A downhole casing system according to claim 5, wherein valves, throttles and/or inflow control devices are arranged in the connecting passages.

* * * * *